United States Patent [19]

Sloan

[11] Patent Number: 4,867,277

[45] Date of Patent: Sep. 19, 1989

[54] PORTABLE LIFTING DEVICE AND CART

[76] Inventor: William C. Sloan, R.R. 1 Box 62 A, Dallas Center, Iowa 50063

[21] Appl. No.: 250,601

[22] Filed: Sep. 29, 1988

[51] Int. Cl.[4] ..... B66B 11/04

[52] U.S. Cl. ..... 187/9 E; 187/18

[58] Field of Search ..... 187/9 E, 18, 8.71, 9 R; 182/141, 148, 69, 63; 254/122

[56] References Cited

U.S. PATENT DOCUMENTS

| | | | |
|---|---|---|---|
| 96,698 | 11/1869 | Heuermann | 187/18 X |
| 2,086,255 | 7/1937 | Cashier et al. | 182/69 X |
| 3,000,473 | 9/1961 | Reynolds | 187/63 X |
| 3,738,502 | 6/1973 | Noller | 187/9 E X |
| 4,074,819 | 2/1978 | Labourre | 182/141 X |
| 4,375,248 | 3/1983 | Kishi | 187/18 |
| 4,405,116 | 9/1983 | Eisenberg | 182/141 X |
| 4,427,093 | 1/1984 | Wehmeyer et al. | 182/141 |
| 4,447,041 | 5/1984 | Fujita | 254/122 X |
| 4,458,786 | 7/1984 | Lebre | 187/9 R |
| 4,545,463 | 10/1985 | Olovsson | 187/9 R |
| 4,619,346 | 10/1986 | Deguerry | 187/9 E |
| 4,655,466 | 4/1987 | Hanaoka | 187/18 X |

FOREIGN PATENT DOCUMENTS

| | | | |
|---|---|---|---|
| 1303134 | 7/1962 | France | 187/9 R |
| 4521573 | 7/1980 | Japan | 187/8.71 |

*Primary Examiner*—Joseph J. Rolla
*Assistant Examiner*—Stephen B. Parker
*Attorney, Agent, or Firm*—Donald J. Breh

[57] ABSTRACT

A portable lifting device and cart is disclosed including a base having a pantographic lifting mechanism and a platform slidably connected and supported to upstanding support members. A plurability of stabilizer legs and struts pivotably attached to the base and support members provides for stability.

13 Claims, 2 Drawing Sheets

PORTABLE LIFTING DEVICE AND CART

BACKGROUND OF THE INVENTION

This invention relates to a lifting apparatus. More particularly this invention relates to a portable, combination lifting apparatus and material handling cart.

Portable lifting devices are known, for example, such as those disclosed in U.S. Pat. Nos. 4,375,248, 4,427,093, 4,458,786 and 4,619,346 all of which are relatively large, heavy structured devices mounted on wheels and having different extending and retracting lifting mechanisms for positioning a platform. As is well known, these types of devices are rather top heavy and can become substantially unstable especially when fully extended and heavily loaded. Most such devices have only one support or stabilizing means usually in the form of vertical legs mounted to the base which are extended to contact the ground. Typical stabilizers or levelers are shown in U.S. Pat. Nos. 4,427,093 and 4,375,248. These legs, because they are vertically orientated, do not always provide sufficient vertical stabilization to such devices. The device is still able to tip about the legs when subjected to horizontal loads with the lift fully extended. Further, in a pantograph-type device such as in U.S. Pat. No. 4,375,248, the linkage is supported solely at its attachment to the base and is subject to pendulum-type swaying and possible tipping.

SUMMARY OF THE INVENTION

Accordingly, there is a need for a relatively lightweight portable lifting apparatus which provides increased operational stability principally in regard to resistance to tipping.

According to the invention, there is provided a portable lifting device having improved stabilization structure including a plurality of angularly downwardly and outwardly disposed stabilization legs on the base and means for laterally supporting the platform over its entire vertical travel between the fully retracted and fully extended positions.

According to the invention, platform support over its travel is provided by two upstanding support members to which the platform is slidably attached.

According to a further important aspect of the invention, additional stabilization is provided through a pair of elongated stabilizer struts one mounted to each upstanding support member and disposed angularly downwardly away from the support members. The stabilizer struts and stabilizer legs are all configured to include enlarged contact pads at their free ends for engaging the external support surface.

Advantageously, the stabilizer legs and struts are all pivotably mounted for positioning to stored positions and their support positions.

According to an important feature of the invention, extension members are provided for removable attachment to the upstanding support members for extending the vertical range of the device.

Another feature of the invention provides for the platform slidable support attachment to the upstanding support members to be through a pair of split-ring members on the edge of the platform which are slidably received around cylindrical support members.

According to another feature of the invention, the lift linkage is driven by a reversible electric motor.

BRIEF DESCRIPTION OF THE DRAWINGS

The invention will be better understood after reading the following Detailed Description of the Preferred Embodiment in conjunction with the drawing in which.

DETAILED DESCRIPTION OF THE PREFERRED EMBODIMENT

Figure 3:
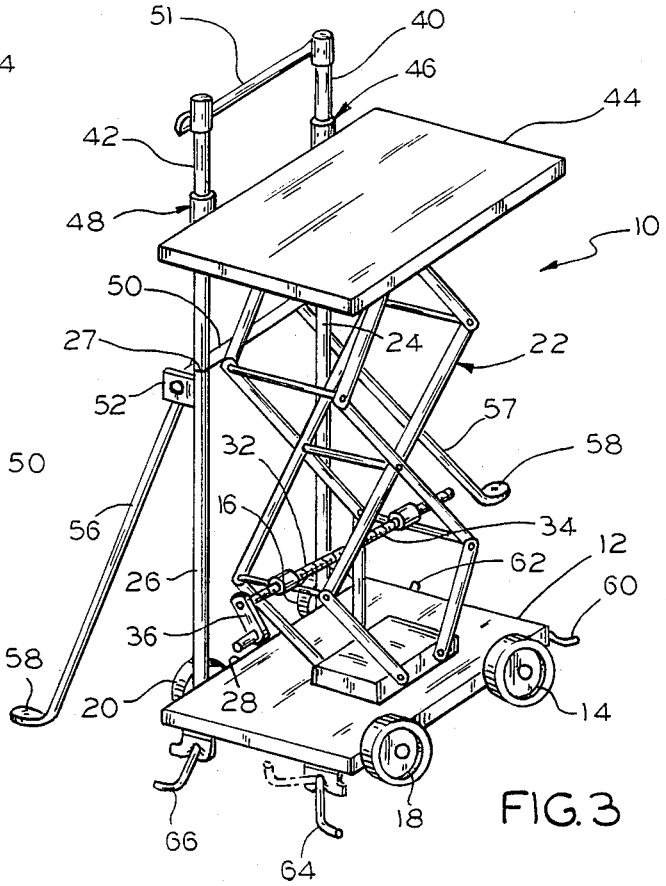
FIG. 3 is a perspective view of the lifting device according to the invention.

Shown in FIG. 3 is a lifting apparatus 10 including a base 12 having four wheels 14, 16, 18, 20 two of which, such as wheels 14, 16, are mounted on a short edge of the base and are preferably mounted for steerability.

A pantographic or scissors-type lift mechanism 22 having multiple links is mounted centrally on the base 12 and centrally between two spaced apart cylindical or tubular upstanding support members 24, 26 which are affixed to one long edge 28 of the base 12. The lift mechanism is of common design and includes a threaded member 30 having oppositely directed threaded portions 32, 34 for operating the links of the mechanism. Either a hand operated crank 36, or a reversible electric motor 38 coupled to the member 30 can be used to drive the member 30 and the lift.

Figure 2:
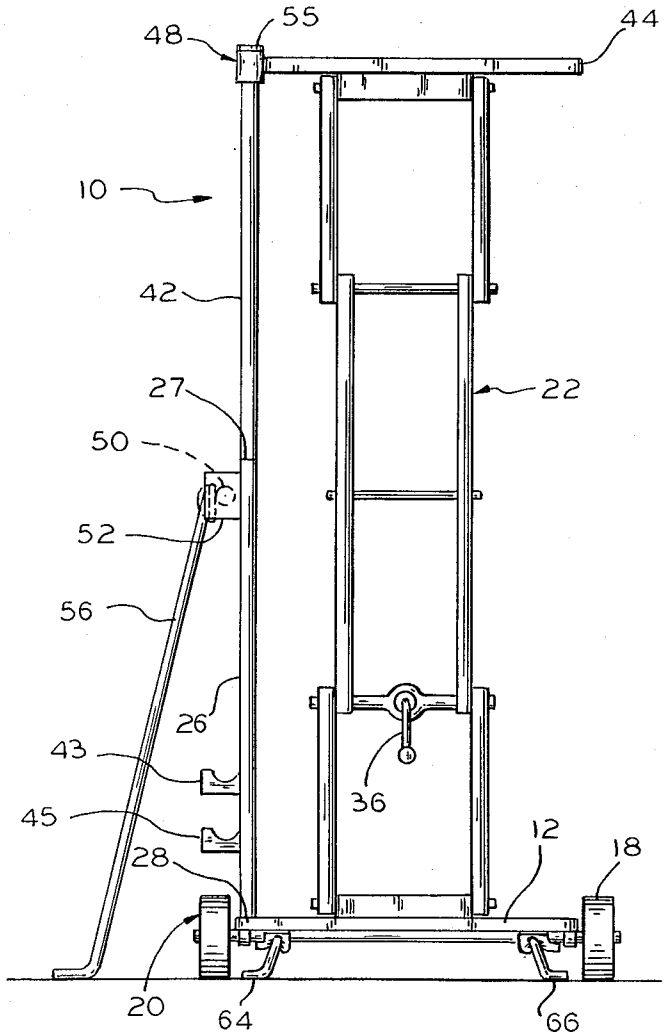
FIG. 2 is an end view of the lifting device showing details of construction.

The upstanding members 24, 26 can be one continuous member extending up to the desired fully extended position of the platform or alternatively can comprise multiple sections such as fixed members 24, 26 which are mounted to the base 12 and a pair of removable extension members 40, 42. The extension members are provided with reduced diameter lower ends which can be removably, slidably received in the top ends 25, 27 of the lower tubular fixed support members 24, 26. When not in use, the extension members can be stored for example in optional brackets 43, 45 attached to the fixed support members, as shown in FIG. 2 for later use.

A work platform 44 is attached to the lift mechanism and includes two platform support slide connections 46, 48 on one long edge.

Figure 4:
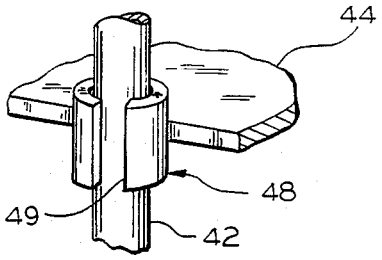
FIG. 4 is an enlarged view showing details of the platform slidable attachment.

As shown in FIG. 4, each slide connection, 42 includes a split-ring 49 that surrounds each support member 24, 26 or extension 40. The slide connections of the platform to the support members provide support to the platform and lift mechanism over its entire travel from its fully retracted position, the platform being shown in the retracted position in dashed outline in FIG. 1, to its fully extended position and all intermediate positions, as shown in phantom in FIG. 1.

Figure 6:
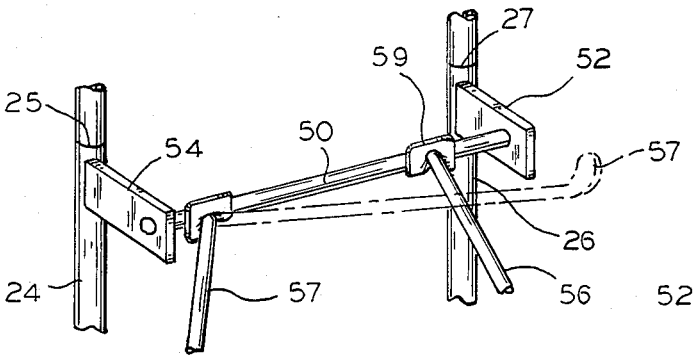
FIG. 6 is a perspective view of a portion of the device in FIG. 3 showing details of attachment of the stabilizer struts to the upstanding support members.
Figure 7:
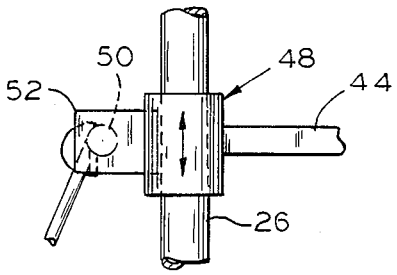
FIG. 7 is an enlarged end view of the attachment of the stabilizer struts to the upstanding support members in conjunction with the slidable attachment of the platform to the upstanding support members.

As shown in FIG. 6, a transverse member 50 connects between the support members 24, 26 near the upper ends 25, 27 through two flat plates 52, 54 welded or otherwise affixed to each fixed support member. The plates have a thickness less than the width of the ring split 49 which allows the split-rings to pass past the projecting plates as the slide connections move over the support members, such as connection 48 shown in FIG. 7.

If desired, an optional removable handrail 51 can be provided either at the ends 25, 27 of the fixed supports 24, 26 if the extensions 40, 42 are not used or the handrail can be removed from the fixed supports and reattached to the free ends of the extension members 40, 42 when they are used, as shown in FIG. 3. The handrail further functions to tie the upstanding support members together and in particular, the upper extensions when used. The handrail also functions as a stop against which the platform slides can engage in the fully extended position to limit movement. Alternatively, removable caps 53, 55 can be provided at the free ends of each extension member to limit the lift travel as shown in FIG. 1.

Figure 5:
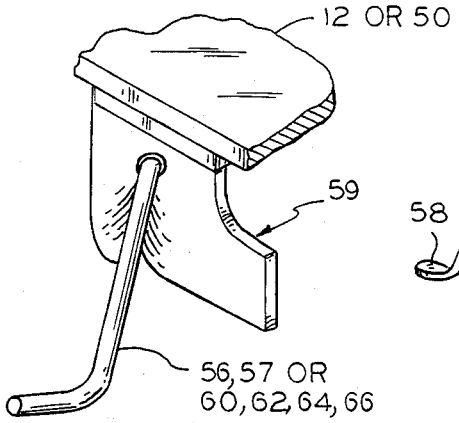
FIG. 5 is an enlarged view showing details of a preferred pivotable attachment for the stabilizer legs and struts.

Pivotably attached to the transverse member 50 near each upright support are two enlongated stabilizer struts 56, 57. The struts are each attached through a kickstand-type attachment 59, preferably of the type shown in FIG. 5, which provides for alternative positioning of each strut in a stored position, one of which, 57, is shown in a stored position in FIG. 6 in dashed outline, and an extended support position, as shown in FIGS. 1, 2, and 3. The pivotable connection shown in FIG. 5 is representative only and those skilled in the art can readily devise other pivotable and or kickstand type attachments. Preferably, each strut depends downwardly, angularly outwardly away from the support members in generally opposite directions as shown in FIG. 4. The free end of each strut is provided with an enlarged area support pad 58 which engages against the floor or external support surface. Preferably, the transition from the elongated portion of the strut to the contact pad portion, and if desired, a portion of the contact pad support surface can be slightly curved or rounded to facilitate engagement with the external support surface when the strut is pivoted to the support position. Also, the stabilizer strut can be made longitudinally telescopic by well known means to compensate for uneven support surfaces.

Figure 1:
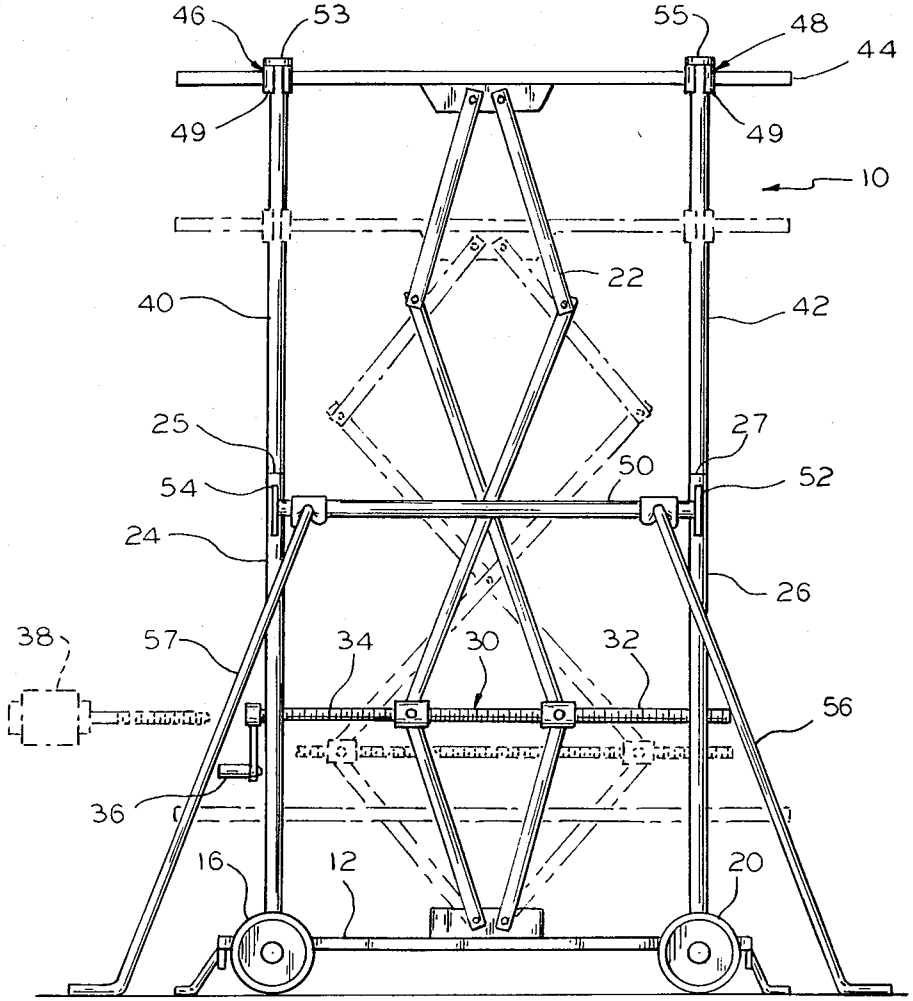
FIG. 1 is a side view of a lifting device according to the invention showing details of construction and operation.

As shown in FIG. 1, there are four stabilizer legs 60, 62, 64, 66 of similar construction as the struts 56, 57 provided at each corner of the base 12. The stabilizer legs are also each pivotably mounted to the base with preferably a kickstand-type mounting 59 of the type shown in FIG. 5 providing for selective positioning at stored positions and support positions as shown in FIG. 3.

It is contemplated that this lifting device can be particularly effective in the building trades, for example, for carting supplies and lifting workman and materials including sheet rock. Therefore, it is desirable that the platform have dimensions of about 36 inches by 48 inches, that the stationary support members 24, 26 and the extensions 40, 42 would each have lengths of about 48 inches providing for a total lift height of about 96 inches.

Having described the preferred embodiment of the invention, those skilled in the art having the benefit of the description can readily devise other embodiments and modifications and such other embodiments and modifications are to be considered to be within the scope of the appended claims.

What is claimed is:

1. A portable lifting device and cart comprising:

a base;

a pair of upstanding support members extending from said base;

two pair of wheels mounted to said base;

a pantographic lift mechanism mounted on said base;

a platform mounted on said lift mechanism;

means attaching said platform to each of said upstanding support members for slidable movement over the length of said support members;

drive means operatively connected to said lift mechanism for extending and retracting said lift mechanism to an infinite number of positions between a fully retracted position and a fully extended position;

a plurably of stabilizer legs, each leg pivotably mounted to said base for alternative positioning at a stored position and a support position whereat said leg is disposed downwardly, angularly outwardly away from said base, said leg configured to engage an external support surface in said support position;

at least two elongated pivotal stabilizer struts one operably connected to each of said upstanding support members for alternative positioning in a stored position and a support position whereat said strut is disposed downwardly, angularly away from said support members and away from each other, said strut having a configuration to engage the external support surface in the support position.

2. The lifting device and cart as defined in claim 1 wherein said upstanding support members are co-planar, parallel, cylindrical members.

3. The lifting device and cart as defined in claim 2 wherein said base is rectangular and said upstanding support members are attached to one long edge of said base.

4. The lifting device and cart as defined in claim 2 further comprising a pair of upstanding support extension members each adapted to removeably attach at ends of said upstanding support members.

5. The lifting device and cart as defined in claim 2 wherein said means for attaching said platform to said upstanding support members includes a pair of ring-shaped members on an edge of said platform, one ring-shaped member slidably received around each of said upright support members.

6. The lifting device and cart are defined in claim 5 wherein said ring-shaped members are split rings.

7. The lifting device and cart as defined in claim 6 further including a crossmember interconnecting said upstanding support members, said crossmember configured to allow passage of said split ring as said split ring slides on said upstanding support member.

8. The lifting device and cart as defined in claim 7 further including a pair of upstanding support extension members each adapted to removeably attach at ends of said upstanding support members.

9. The lifting device and cart as defined in claim 8 including stop means at the free end of each of said upstanding support members.

10. The lifting device and cart as defined on claim 1 wherein the free end of each of said stabilizer legs and said stabilizer struts includes an enlarged support pad.

11. The lifting device and cart as defined in claim 1 wherein said drive means is a reversible electric motor.

12. A portable lifting device and cart comprising:

a rectangular base;

a wheel mounted to said base proximate each corner of said base;

two parallel upstanding tubular support members extending from one long edge of said base;

a pantograhic linkage mechanism mounted on said base centrally between said upstanding support members;

a rectangular work platform mounted to said linkage mechanism, said platform including two split-ring members on a long edge of said platform one slidably received around each of said upstanding support members;

drive means for selectively moving said linkage mechanism to position said platform at an infinite number of positions between a fully retracted position and a fully extended position;

stop means on said upstanding support members contacted by said split-ring members in the fully extended position;

four stabilizer legs, one pivotably mounted to said base proximate each corner of said base for alternative positioning at a stored position and a support position disposed downwardly, angularly away from said base; and two elongated pivotal stabilizer struts one operably connected to each of said upstanding support members for alternative positioning at a stored position and a support position disposed downwardly, angularly away from said upstanding support members and away from each other.

13. A portable lifting device and cart comprising: a base;

a pair of spaced apart, parallel upstanding support members extending from said base;

four wheels mounted to said base, two adjacent wheels being steerable;

a scissors-type lift mechanism mounted to said base;

drive means for extending and retracting said scissors lift mechanism;

a platform mounted to said lift mechanism;

means for mounting said platform to said upstanding support members for slidable movement over the length of said upstanding support members;

first stabilizer means including a pluralility of stabilizer legs each pivotably mounted to said base for positioning at a stored position and a support position disposed downwardly, angularly away from said base; and second stabilizer means including two stabilizer struts one pivotably mounted at attachment locations operably connected to each upstanding support member for positioning in a stored position and a support position disposed downwardly, angularly away from said support members, free ends of the stabilizer struts being spaced apart a greater distance from each other than a spacing of the attachment locations of said struts.

* * * * *